United States Patent [19]

Sonerud

[11] 4,092,790

[45] June 6, 1978

[54] FLOATABLE APPARATUS FOR EXCAVATING AND TRANSPORTING EXCAVATED MATERIAL

[76] Inventor: John Teodor Sonerud, Vintervagen 30, 82400 Hudiksvall, Sweden

[21] Appl. No.: 748,681

[22] Filed: Dec. 8, 1976

[30] Foreign Application Priority Data

Dec. 9, 1975 Sweden ..... 7513866

[51] Int. Cl.[2] ..... E02F 3/44

[52] U.S. Cl. ..... 37/71; 114/53

[58] Field of Search ..... 37/71, 54, 74, 73, 56; 114/16.8, 53, 52

[56] References Cited

U.S. PATENT DOCUMENTS

| | | | |
|---|---|---|---|
| 1,767,672 | 6/1930 | Hills | 114/53 |
| 1,881,123 | 10/1932 | Francis | 114/53 |
| 3,064,370 | 11/1962 | La Fleur | 37/71 |
| 3,777,919 | 12/1973 | Konijn | 37/73 X |
| 3,782,317 | 1/1974 | Kriedt et al. | 114/52 |

FOREIGN PATENT DOCUMENTS

| | | | |
|---|---|---|---|
| 1,759,981 | 7/1971 | Germany | 37/71 |
| 2,411,115 | 9/1974 | Germany | 37/71 |

*Primary Examiner*—Clifford D. Crowder

*Attorney, Agent, or Firm*—Blanchard, Flynn, Thiel, Boutell & Tanis

[57] ABSTRACT

An apparatus for excavating and transporting excavated material, said apparatus including a nonfloating frame structure having a pair of opposed shovels swingably supported on the opposite sides thereof. A drive mechanism is connected between the frame structure and the shovels for swingably moving the shovels relative to the frame structure. At least two buoyant bodies having a predetermined buoyancy are movably connected to the frame structure at the opposite ends thereof. An operating mechanism is connected between the frame structure and the buoyant bodies for raising and lowering the frame structure and the shovels as a unit relative to the buoyant bodies. The operating mechanism is independently operable in relationship to the drive mechanism.

8 Claims, 3 Drawing Figures

FLOATABLE APPARATUS FOR EXCAVATING AND TRANSPORTING EXCAVATED MATERIAL

BACKGROUND OF THE INVENTION

The present invention refers to an apparatus for excavating and transporting excavated quantities.

It is previously known to arrange an excavating machine on pontoons for carrying out excavation work in areas of shallow water. With such pontoon arrangements there is usually a stability problem when excavation is to be done sideways outside the pontoons. In order to compensate to a certain extent for the tipping tendencies in such excavation it is usual to provide the pontoons with extra buoyant bodies or with supporting legs projecting down to the sea/lake floor for support, or a combination of such arrangements. In spite of taking such measures, the possibilities of utilizing large excavating shovels for taking up comparatively large quantities of earth at each excavating movement are limited. Excavating work on the sea/lake floor is concerned in most cases with moving earth quantities from one place to another, e.g. for dredging a channel for a navigable passage or providing a trench on the floor for a pipeline, cable or the like. It is thus more seldom a question of lifting up earth quantities from the sea/lake floor and dumping these on land. On the other hand, it is desirable to transport such large earth quantities as is possible in each excavating operation, since when working in water it is necessary to expect considerable slipping back of earth quantities in the excavated area, as well as loss of earth quantities during transport under water.

The present invention intends to solve the above-mentioned problem in a simple and effective way. The apparatus comprises a generally simple frame structure, to which there is attached a power shovel apparatus, pivotable in relation to said frame. The frame is built up, per se, of preferably two or more vertically mobile pontoons with sufficient buoyancy for lifting up and transporting earth quantities excavated from the floor.

The invention will now be described while referring to the attached drawing which shows an embodiment of the invention.

DETAILED DESCRIPTION

Figure 1:
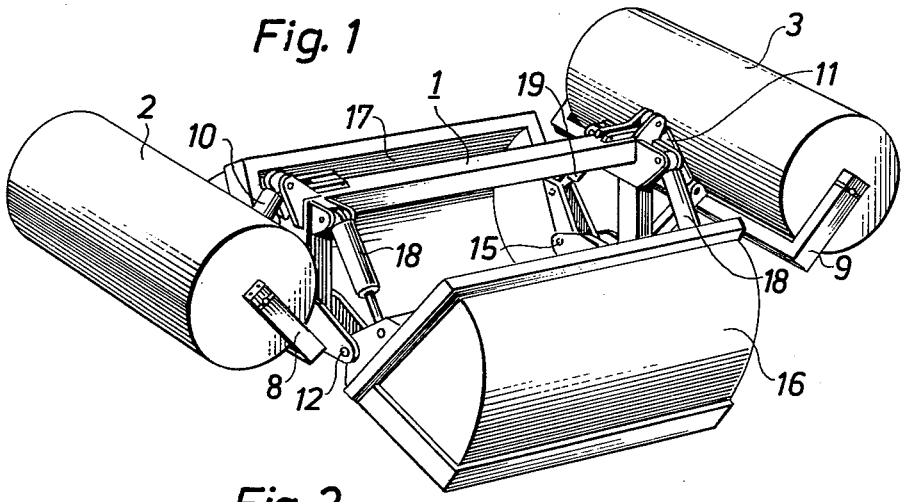
FIG. 1 is a perspective view of the apparatus.

The apparatus shown consists of a rectangular frame 1 to which there is attached two pontoons 2,3 by means of arms 4,5, respectively. The arms are linked to the frame at oscillation points 6,7, respectively, arranged in lugs projecting from the frame. The pontoons 2,3, which are cylindrical, are rotatably mounted in fork-like elements 8,9, respectively, which are attached to the outer ends of said arms 4,5. The oscillating movement of the pontoons is arranged to be provided by the hydraulic cylinders 10, 11, fastened between the upper corner portions of the frame 1 and attaching lugs arranged on the outer portions of said arms 4,5.

Figure 2:
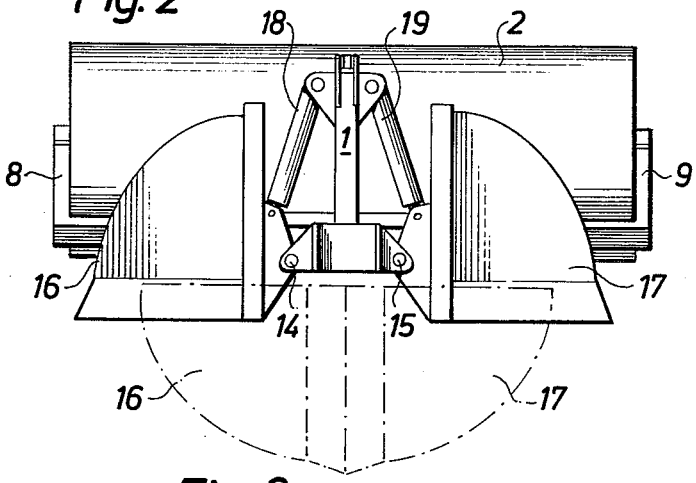
FIG. 2 is an end view of the apparatus shown in FIG. 1 with one pontoon removed, whereby the area of movement of the power shovel itself is apparent.

At the lower corner portions of the frame 1, two power shovel halves 16,17 are pivotably mounted on pins 14–15 carried by attaching lugs. As is apparent from FIG. 2 the power shovel halves are so arranged that in a swung-up position the excavating opening formed between the halves is facing downwards. The power shovel halves 16,17 are arranged to pivot by means of two pairs of hydraulic cylinders 18,19, respectively, arranged between the attaching lugs between the upper portion of the frame 1 and the upper edge portions of the excavating shovel halves. So as not to make the figures unnecessarily complicated, the operating lines to said hydraulic cylinders have been omitted.

OPERATION

Figure 3:
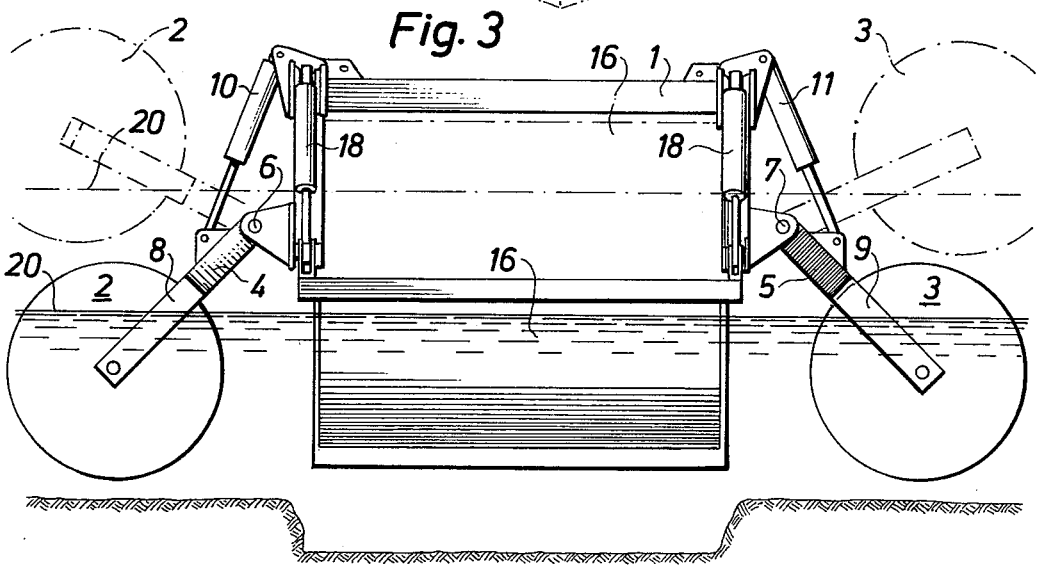
FIG. 3 shows different working positions of the apparatus according to FIGS. 1 and 2, seen from one side.

The apparatus functions in the following way:

When an excavating operation is to be carried out, both excavating shovel halves 16,17 are first taken up into the swung-up position (FIG. 2), during which the pontoon arms 2,3 are naturally in their most downwardly swung position, i.e. so that the apparatus rides high. Hereafter the hydraulic cylinders of the pontoon arrangements are operated in such a direction that the arms are swung upwardly (the position in full lines in FIG. 1, and chain lines in FIG. 3), which means that the frame 1 will be lowered down under the water surface with its power shovel halves so that the power shovel halves come into contact with the sea/lake floor. The hydraulic cylinder pairs 18,19 for the power shovel halves 16,17 are now actuated so that the power shovel halves make a digging movement down through the sea/lake floor up to a closing position of the power shovel (chain dotted in FIG. 2). Hereafter the hydraulic cylinders 10,11 for the pontoons 2,3 are actuated in a downwardly swinging direction. The pontoons will hereby sink down in the water, successively increasing the lifting force. When the lifting force has become the same as the weight of the load, power shovel and frame, the apparatus will float (full lines in FIG. 3). On continued movement of the pontoon arms 2,3, the power shovel will be lifted substantially to the water surface 20, FIG. 3, whereafter the whole array can be moved in a buoyant attitude to some suitable place for dumping the contents of the power shovel. Dumping is done by the hydraulic cylinder pairs 18,19 of the power shovel arms being actuated to a position opening the shovel halves. A new excavating operation can be subsequently begun in the way described above.

If, however, it is desired to transport the excavated material onto land, the entire pontoon array can be towed sideways so that the cylindrical pontoons can roll on the sea/lake floor and up onto land, carrying the frame and the shovel between them to form a kind of vehicle. As is apparent from FIG. 3, in the most downwardly-swung position of the pontoons, the underside of the shovel 16,17 is at a level higher than the line connecting the lowest points of the pontoons.

It is naturally possible within the framework of the invention to arrange more than two pontoons, if more lifting force is required or if, for some reason, some other functions are required for the apparatus. For example, it is possible to arrange two further pontoons outside the power shovel itself, i.e. on either side of the power shovel between the pontoons 2,3. With such an arrangement two further optional directions can be obtained for transporting quantities onto land. It is naturally not necessary to make the pontoons as cylinders as shown in the above-described embodiment, and these can be given any shape at all, suitable for the purpose in question. It is also possible to provide the frame 1 with further buoyant bodies to increase the total lifting capacity. A solution can be conceived in which the upper edges of the shovel halves are made with a buoyant body so that when the halves are swung together a common roof is formed on the shovel, said roof simultaneously constituting an additional pontoon. The frame 1 or the pontoons or any of the latter can naturally be provided with propeller machinery for propelling the entire array in the water. The pontoons can also be provided with driving machinery for rotating them and for providing self-moving transport of earth quantities on the sea/lake floor and/or land. To combine both the propelling function in water with transport on land, the cylindrical pontoons can be provided with paddles or the like at the sides to provide a paddle wheel effect on rotation in water.

Such arrangements can also be conceived where the frame is attached to the lifting apparatus of a crane which, per se, can be based on land or placed on a special pontoon. The pontoons can hereby serve as additional help for breaking up earth masses under water so that the crane apparatus itself does not need to be so heavily loaded with the work of breaking up. In connection with excavation work, it is in general conceivable to actuate the pontoons individually by only supplying, for example, one pontoon with a downward movement, whereby a lateral displacing effect is supplied to the shovel which can contribute to breaking away earth which sits solidly. The power shovel can naturally be replaced by a grab or the like where circumstances so require. It is also conceivable to join the frame 1 by means of an arm or the like to a further pontoon arrangement supporting a working place for an operator and the necessary driving units for the hydraulic cylinders in question or also an arrangement for carrying a propelling unit.

There is naturally nothing to prevent using an apparatus according to the invention for excavating on land, substantially the same movement pattern being carried out as with excavating in water, with regard to pontoon movements and power shovel movements. In such a case it can be advantageous if the pontoon arrangements 2,3 are rotatable since they must execute rolling movement relative to the ground when the arms 4,5 are swung.

What I claim is:

1. A floatable device for excavating and transporting excavated material, comprising:

a nonfloating frame structure;

a shovel comprising two shovel sections swingably supported directly on said frame structure for relative swinging movement toward and away from one another;

at least two buoyant bodies having a predetermined buoyancy and being movably connected to said nonfloating frame structure at opposite ends thereof;

operating means connected between said frame structure and said buoyant bodies for lowering said frame structure and said shovel as a unit relative to said buoyant bodies when an excavating operation is to be performed and for raising said unit relative to said buoyant bodies after the excavating operation has been completed and the shovel contains excavated material therein;

drive means connected between said frame structure and said shovel sections for swinging said shovel sections relative to said frame structure, said drive means and said operating means being independently operable in relation to one another, and said drive means causing swinging of said shovel sections when said unit is in said lowered position for performing an excavating operation; and the buoyant capability of said buoyant bodies together being such that they carry the full load of the shovel and the frame structure in a stable floating condition.

2. A device according to claim 1, wherein the frame structure comprises a substantially vertically oriented rectangular frame, said two shovel sections comprising two shovel halves positioned adjacent the opposite sides of said rectangular frame and being swingably supported directly on said rectangular frame adjacent the lower edge thereof, and said drive means connected between said shovel halves and said rectangular frame for causing said shovel halves to be swingably displaced relative to said frame in opposite rotational directions.

3. A device according to claim 2, wherein said buoyant bodies are positioned adjacent the opposite ends of said frame, a pair of swinging arms swingably supported on said rectangular frame adjacent the opposite ends thereof, said arms having said buoyant bodies mounted thereon adjacent the outer ends thereof, said operating means causing said arms to be swingably displaced relative to said frame in opposite rotational directions.

4. A device according to claim 3, wherein said operating means includes first fluid pressure cylinder means interconnected to said arms for causing swinging thereof, and said drive means comprising second fluid pressure cylinder means interconnected to said shovel halves for causing swinging movement thereof.

5. A device according to claim 4, wherein said first fluid pressure cylinder means includes a pair of first fluid pressure cylinders operatively connected between said rectangular frame and a respective one of said arms, and wherein said second fluid pressure cylinder means includes a pair of second fluid pressure cylinders operatively connected between said rectangular frame and a respective one of said shovel halves.

6. A device according to claim 3, wherein each of said arms has a forklike structure provided at the outer end thereof, and each said buoyant body comprising a cylindrical container rotatably positioned between and supported on said forklike structure, and cylindrical container being supported for rotation about its longitudinal axis, with said axis extending substantially parallel to the pivot axis defined by said arm.

7. A device according to claim 1, wherein said two shovel sections comprise two shovel halves positioned adjacent the opposite sides of said frame structure and being pivotally supported on said frame structure for swinging movement relative to said frame structure in opposite rotational directions, arm means projecting outwardly from opposite ends of said frame structure and being swingably movable relative to said frame structure within a plane which is substantially perpendicular to the plane of swinging movement of said shovel halves, said arm means having said buoyant bodies mounted thereon whereby said buoyant bodies are thus positioned outwardly from opposite ends of said frame structure.

8. A device according to claim 1, wherein said two shovel sections comprise two shovel halves, said shovel halves being pivotally connected directly to said frame structure on opposite sides thereof, and said buoyant bodies being disposed adjacent the opposite ends of said frame structure whereby said shovel halves are disposed therebetween.

* * * * *